US006345595B2

(12) United States Patent
Yamada

(10) Patent No.: US 6,345,595 B2
(45) Date of Patent: Feb. 12, 2002

(54) CONTROL APPARATUS FOR VARIABLY OPERATED ENGINE VALVE MECHANISM OF INTERNAL COMBUSTION ENGINE

(75) Inventor: Yoshihiko Yamada, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/760,712

(22) Filed: Jan. 17, 2001

(30) Foreign Application Priority Data

Jan. 18, 2000 (JP) ..... 2000-008530
Sep. 20, 2000 (JP) ..... 2000-284507

(51) Int. Cl.[7] ..... F01L 1/34
(52) U.S. Cl. ..... 123/90.15; 123/90.17; 74/568 R; 464/2
(58) Field of Search ..... 123/90.12, 90.15, 123/90.16, 90.17, 90.18, 198 C; 74/568 R; 464/1, 2, 160

(56) References Cited

U.S. PATENT DOCUMENTS 4,517,934 A * 5/1985 Papez ..... 123/90.17
4,862,845 A * 9/1989 Butterfield et al. ..... 123/90.15
5,557,983 A 9/1996 Hara et al. ..... 74/568 R
5,680,837 A * 10/1997 Pierik ..... 123/90.17
5,860,328 A * 1/1999 Regueiro ..... 74/568 R
5,915,348 A * 6/1999 Scheidt et al. ..... 123/90.17
6,129,062 A 10/2000 Koda ..... 123/90.17
6,234,125 B1 * 5/2001 Neubauer et al. ..... 123/90.17

FOREIGN PATENT DOCUMENTS

JP 9-060507 3/1997
JP 11-117719 4/1999

OTHER PUBLICATIONS

U.S. application No. 09/414,640, Torii et al., filed Oct. 8, 1999.

* cited by examiner

*Primary Examiner*—Weilun Lo
(74) *Attorney, Agent, or Firm*—Foley & Lardner

(57) ABSTRACT

In a control apparatus for a variably operated engine valve mechanism of an internal combustion engine, a phase converter is disposed to variably control at least one of a displacement and an open-and-closure timing of an engine valve; an oil pump to supply a hydraulic to operate the phase converter, a reversible motor of DC type is disposed to drivingly revolve the oil pump, and a controller is disposed to output a drive current to the reversible motor according to an engine driving condition, the controller controlling a revolution direction of the oil pump via the reversible motor at least when an operation of the phase converter is switched.

18 Claims, 13 Drawing Sheets

ECU
DRIVER
CPU
ROM
RAM
INPUT PORT
OUTPUT PORT
TO 38
FROM 37
$C_P$
$K_P$
$\theta_T$
Q
A
A

CONTROL APPARATUS FOR VARIABLY OPERATED ENGINE VALVE MECHANISM OF INTERNAL COMBUSTION ENGINE

BACKGROUND OF THE INVENTION a) Field of the Invention

The present invention relates to a control apparatus for a variably operated engine valve mechanism which variably controls a valve displacement or an open-and-closure timing of an engine valve of an intake or exhaust valve of an internal combustion engine.

b) Description of the Related Art

A Japanese Patent Application First Publication No. Heisei 9-60507 published on Mar. 4, 1997 exemplifies a previously proposed engine valve (intake valve) open-and-closure timing regulating apparatus.

The disclosed engine valve open-and-closure timing Regulating apparatus is of a vane type. In the disclosed engine valve open-and-closure timing regulating apparatus, a vane fixed on an end of a camshaft is rotatably housed within a cylindrical housing of a timing pulley whose opening end is enclosed with a front cover and a rear cover. An advance angle side oil chamber and a retardation angle side oil chamber are defined between two partitioning walls and two blade sections of the vane. The two partitioning walls are of substantially two trapezoid shapes projected mutually from the diameter direction on an inner peripheral surface of the housing.

In addition, an oil pressure drained from an oil pump rotationally driven with a motor is supplied selectively with a motor is supplied selectively with an electromagnetic switch valve to one of advance angle side oil pressure chamber or a retardation angle side pressure chamber by the change of flow passages. Then, the drive of pressure causes the vane to be rotated in a normal or reverse direction so that a relative rotation phase between the timing pulley and the cam shaft is varied and the open-and-closure timing of the intake valve is variably regulated.

SUMMARY OF THE INVENTION

However, in the previously proposed open-and-closure timing control apparatus, in order to supply the oil pressure selectively to each of the advance and retardation angle side oil chambers, a flow passage of working oil drained from the oil pump is merely switched using the electromagnetic switching valve.

Hence, an energy loss in the oil pump occurs. That is to say, even after the working oil is supplied to one of the advance and retardation angle side oil chambers from the flow passage switched by the electromagnetic switching valve so that the vane is held at a rotation position of a maximum advance angle side or a maximum retardation angle side. The oil pump is always revolved in the same direction to perform a continuous draining action. An extra working oil drained is exhausted directly from a drain passage.

Consequently, the energy loss in the oil pump is generated and a reduction of the energy efficiency occurs.

In addition, a high cost electromagnetic switching valve is used for the switch of the flow passage, a high manufacturing cost of the whole regulating apparatus will be resulted.

It is an object of the present invention to provide a control apparatus for a variably operated engine valve mechanism which can solve the above-described problems, i.e., the reduction of the energy loss in the oil pump and no use of the expensive electromagnetic switching valve.

According to one aspect of the present invention, there is provided a control apparatus for a variably operated engine valve mechanism for an internal combustion engine, comprising: a phase converter to variably control at least one of a displacement and an open-and-closure timing of an engine valve; an oil pump to supply a hydraulic to operate the phase converter; a reversible motor to drivingly revolve the oil pump; and a controller to output a drive current to the reversible motor according to an engine driving condition, the controller controlling a revolution direction of the oil pump via the reversible motor at least when an operation of the phase converter is switched.

This summary of the invention does not necessarily describe all necessary features so that the invention may also be a sub-combination of these described features.

DETAILED DESCRIPTION OF THE PREFERRED EMBODIMENT

Reference will hereinafter be made to the drawings in order to facilitate a better understanding of the present invention.

(First Embodiment)

Figures 1A, 1B:
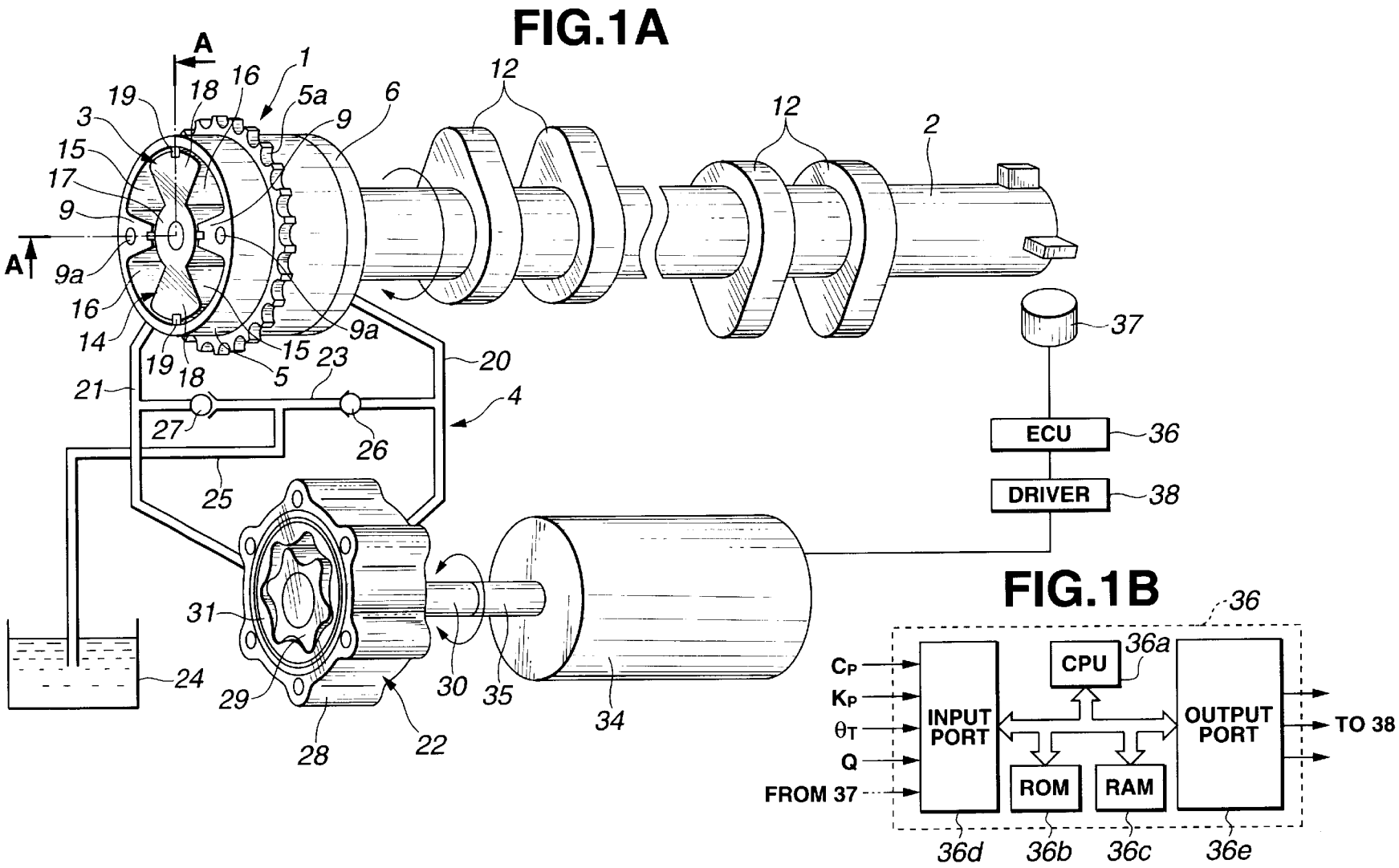
FIG. 1A is a generally perspective view of a control apparatus for a variably operated engine valve mechanism, a phase converter of which is applicable to a vane type phase converter.
FIG. 1B is a schematic circuit block diagram of a controller shown in FIG. 1A.

FIG. 1A shows a first preferred embodiment of a control apparatus for a variably operated engine valve mechanism, a phase converter of which is applicable to a vane type phase converter.

That is to say, the control apparatus includes: a sprocket 1 which is a rotary body revolved with a crankshaft (not shown) of an internal combustion engine via a timing chain; a camshaft 2 relatively pivotable with respect to the sprocket 1; a phase converter 3 disposed between the sprocket 1 and the camshaft 2 to convert a relatively pivotal position of both of the sprocket 1 and the camshaft 2; and a hydraulic circuit 4 to operate the phase converter 3.

Figure 2:
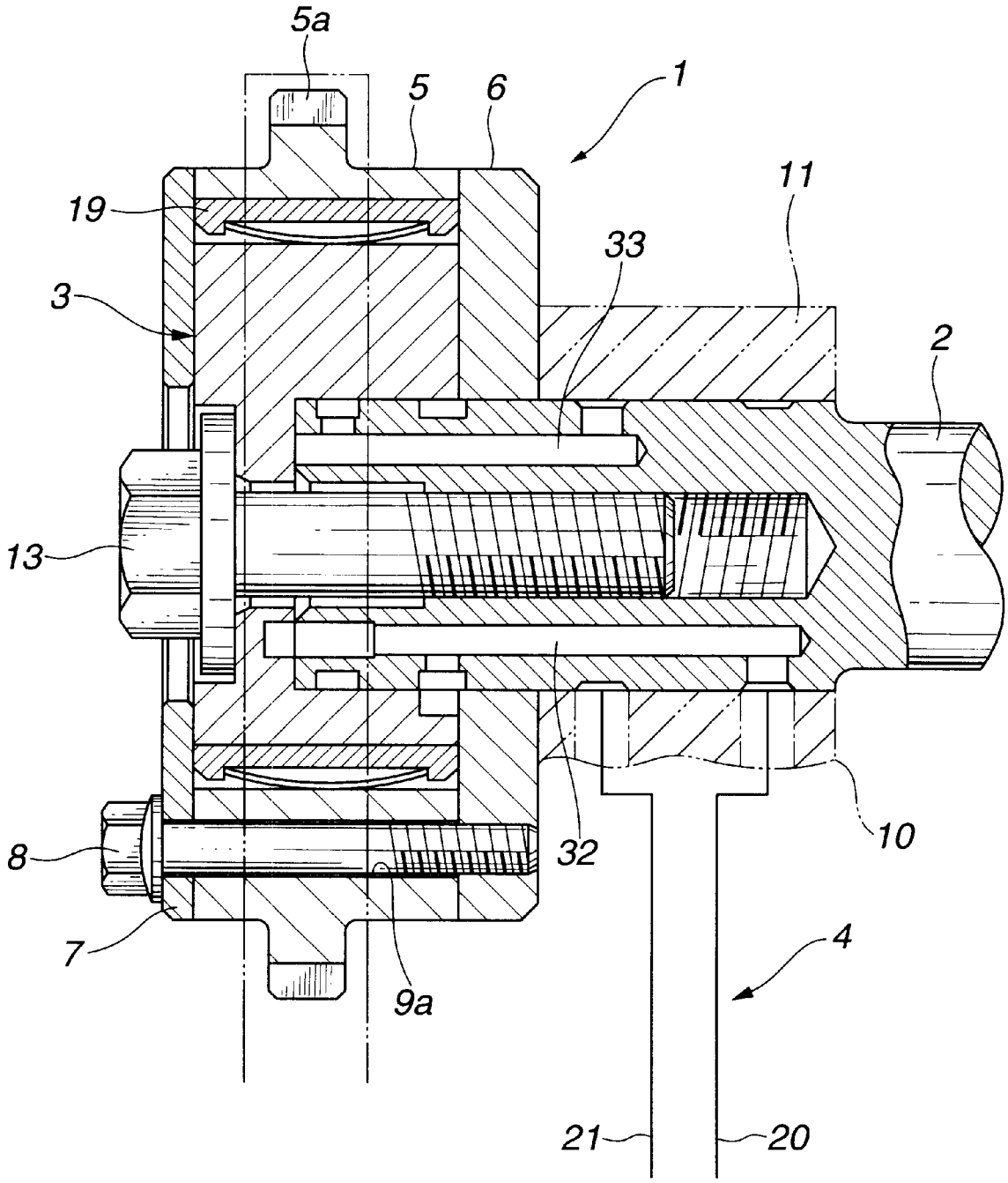
FIG. 2 is a cross sectional view of a phase converter in the first preferred embodiment shown in FIG. 1A cut away along a line A—A in FIG. 1A.

FIG. 2 shows a structure of the sprocket 1.

As shown in FIG. 2, the sprocket 1 includes: a housing 5 having a tooth 5*a* with which the timing chain is meshed; a rear corner 6 which encloses an opening of a rear end of a housing 55; and a front cover 7 of a substantially disc shape of a lid enclosing the opening of a front end of the housing 5. Two bolts 8 are integrally linked from an axial direction with the housing 5, the rear cover 6, and the front cover 7.

The housing 6 is of a cylindrical shape and both of front and rear ends are opened as shown in FIGS. 1A and 2. Two partitioning walls 9 and 9 (refer to FIG. 1A) are respectively of trapezoid shaped in cross section spaced apart at 180-degree position in an inner periphery of the housing along an axial direction of the housing 6. Both end edges have the same phase as the respective end edges of the housing 9 and the bolt inserting holes 9*a* and 9*a* through which the bolt 8 is inserted are penetrated in the axial direction at base ends of the housing 6.

On the other hand, the camshaft 2 is rotatably supported on a cylinder head 10 via a cam bearing 11 (refer to FIG. 2). A plurality of cams 12 to open the engine valve, i.e., the intake valve via a valve lifter (not shown in FIG. 2) are integrally disposed at a predetermined outer peripheral surface position of the cylinder head 10.

The phase converter 3 includes: the sprocket 1 as a rotary body; a vane 14 as a rotary member rotatably housed within the housing 6 fixed on the front end of the camshaft 2 with a bolt 13, two pairs of advance angle side and retardation angle side oil chambers 15 and 15 and 16 and 16 formed within the housing 6 and partitioned with the vane 14 and partitioning walls 9 and 9.

The vane 14 is integrally formed of a sintered alloy material and fixed on the front end portion of the camshaft 2 with a bolt 13 which is inserted into a partitioning hole formed to penetrate through a center of the front end of the camshaft 2. The vane 14 includes: a rotor 17 of a central cylindrical shape formed on the inserting hole; and a pair of blade portions 18, 18 integrally formed at 180-degree position in a peripheral direction of an outer periphery of the rotor 17.

The rotor 17 includes: a pair of seal members 19, 19 located at a symmetrical position of an outer peripheral surface of the phase converter 3 and on which a curved surface of the symmetrical position of each partitioning portion 9 and 9 is slidably contacted. The blade portion 18 is of a sector shape in cross section and the two pairs of advance angle side oil chambers 15 and 15 and retardation angle side oil chambers 16 and 16 are partitioned between both sides of the blade positions 18 and 18 and of the respective partitioning walls 9 and 9.

The respective oil chambers 15 and 15 and 16 and 16 are communicated with communication holes (not shown in FIGS. 1A and 2) formed in a cross shape within the rotor 17.

The hydraulic circuit 4 serves to selectively supply or to drain externally the working oil with respective oil chambers 15 and 16.

The hydraulic circuit 4 includes: a first hydraulic passage 20 via which the oil pressure (hydraulic) is supplied to or drained from the pair of advance angle side oil chambers 15 and 15 as shown in FIG. 1A; a second hydraulic passage 21 via which the oil pressure is supplied to or drained from the pair of the retardation angle side oil chambers 16; an oil pump 22 to selectively supply the hydraulic to each of first and second hydraulic passages 20 and 21; a communication passage 23 to communicate with both of the first and second hydraulic passages 20 and 21; an auxiliary supply passage 25 having a downstream end connected to the oil pump 22 an upstream end connected within a reservoir tank 24; and a pair of check valves 26 and 27 disposed to enable a flow in or out of the hydraulic only toward directions of the hydraulic passages 20 and 21 from the auxiliary passage 25. The hydraulic circuit 4 is wholly in, so-called, a closed-loop.

The first and second hydraulic passages 20 and 21 are communicated with the respective advance angle side working oil chambers 15 and 15 and respective retardation angle side working oil chambers 16 and 16, respectively. Each of the other ends is directly connected with an oil pump 22.

The oil pump 22 is of a torochoid shape, as shown in FIG. 1A. The oil pump 22 includes: an inner teeth 29 of a ring shape rotatably housed in an inner part f a pump body 28 attached on a cylinder head 10; a rotating outer teeth 31 fixed onto a pump axle 30 and meshed with the inner teeth 29; and first and second parts (not shown) to perform both suction and drainage of the working oil pressure. The corresponding first and second hydraulic passages 20 and 21 are connected to the respective ports.

An output axle 35 of the motor 34 is linked to a pump axle 30 of the oil pump 22. The motor 34 is a reversible DC motor. The motor 34 is controlled with a controller 36 detecting a relative pivotal phase between an engine driving condition and the camshaft 2.

FIG. 1B shows an internal structure of the controller 36.

The controller 36 includes: a CPU (Central Processing Unit) 36*a;* a ROM (Read Only Memory) 36*b;* a RAM (Random Access Memory) 36*c;* and a common bus.

The controller 36 inputs information from various sensors such as a crank angle sensor, an airflow meter; a coolant temperature sensor; and an opening angle sensor of a throttle valve, detects the present engine driving condition from the information described above, and outputs a control pulse signal via a drive circuit 38 to the motor 34 by inputting a pivotal phase signal of the camshaft 2 from the above-described timing sensor 37.

Figure 3:
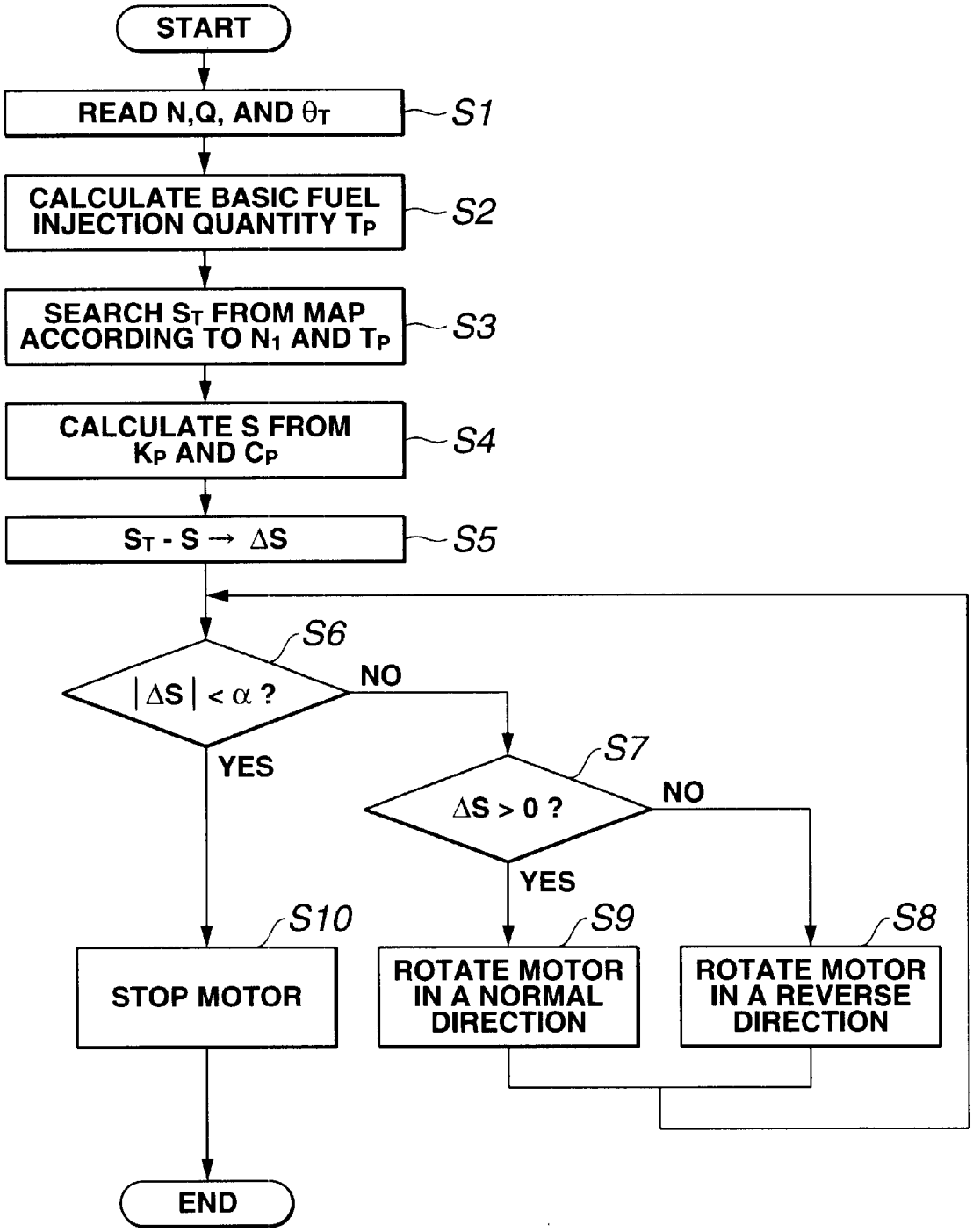
FIG. 3 is an operational flowchart executed by the controller shown in FIG. 1A.

Hereinafter, an operation of the first preferred embodiment of the variably operated engine valve controlling apparatus according to the present invention will be described below with reference to a control flowchart by the controller 36 shown in FIG. 3.

At a step S1, the controller 36 reads an engine speed N of a crankshaft from the crank angle sensor, an intake air quantity Q from an airflow meter, an opening angle θ T from the throttle valve opening angle sensor, respectively.

At the next step S2, the controller 36 calculates the basic fuel injection quantity Tp (not shown) on the basis of each information signal.

At the next step S3, the controller 36 reads a target value ST of a rotational phase of the camshaft 2 from a previously set map according to the engine speed N and the basic fuel injection quantity Tp of the fuel injection values (not shown).

At the next step S4, the controller 36 calculates a pivotal phase S of the camshaft 2 according to a crank rotation signal Kp and a revolution position signal Cp of the camshaft 2.

Furthermore, the controller 36, at the next step S5, calculates a subtraction of the pivotal phase S of the camshaft 2 from a target value ST of the pivotal phase to determine a difference value ΔS.

At a step S6, the controller 36 determines whether the difference value ΔS is equal to or smaller than a predetermined value α. At the next step S6, the controller 36 determines whether the difference value ΔS is equal to or smaller than a predetermined value α (|ΔS|<α). If |ΔS|<α (Yes) at the step S6, the routine goes to a step S10 in which the motor 34 stops If |ΔS|<α (No) at the step S6, the routine goes to a step S7. At the step S7, the controller 36 determines whether the difference value ΔS indicates positive or negative.

If ΔS≧0 at step S7 (Yes), the controller 36 is commanded to rotate the motor 36 in the normal direction through the drive circuit 37. On the other hand, if the difference value ΔS indicates negative at the step S9, namely, when the difference value ΔS indicates negative, in other words, when the pivotal phase S of the cam shaft 2 is in excess of a target value $S_T$ of the pivotal phase S, the controller 36 performs such a control that the motor 34 is reversed in an opposite direction to the normal direction since the engine driving condition is under a low-speed-and-low-load region. Consequently, the pivotal phase S of the camshaft 2 can be suppressed with an error shorter than a predetermined value a with respect to the target value $S_T$ of the pivotal phase.

When the controller 36 reverses the drive motor 34 in the opposite direction as described above under the engine low-speed-and-low-load driving condition, the oil pump 22 performs the reverse rotation to carry out a pumping. As described above, the working oil within the respective advance angle side working oil chambers 15 and 15 is sucked into the oil pump 22 from the first port via the front hydraulic passage 20 so that the respective advance angle side oil chambers 15 and 15 indicates low pressure. On the other hand, the sucked working oil is once drained into the second port due to a pump compression action, is supplied within one retardation angle side working oil chamber 16 via the second hydraulic passage 21, and is supplied to the other retardation angle side working oil chamber 16 via a communication hole so that inner spaces of both retardation angle side working oil chambers 16 and 16 are pressurized to a high pressure. Therefore, the vane 14 is revolved in the counterclockwise direction shown in FIG. 1A and the camshaft 2 is revolved in an opposite direction to the rotation direction of the camshaft 2 per se so that the pivotal phase S is converted into a retardation angle side.

Consequently, an open-and-closure timing of the intake valve is retarded and a combustion efficiency through a utilization of an inertia suction air under the low-speed-and-low-load can be improved. Then, an engine speed can be stabilized and a fuel economy can be improved.

In addition, in a case where the working oil is filled within each retardation side oil chamber 16 and 16 so that the camshaft 2 is pivoted at a maximum retardation angle, the controller 36 commands the driver 38 to stop the reverse rotation of the motor 34 so as to halt the operation of the oil pump 22. Thus, the vane 14 is held as the rotation position.

On the other hand, in a case where the engine is transferred to a high-speed-and-high-load region, the motor 34 is, at this time, commanded to rotate in the normal direction and the oil pump 22 is switched into the normal rotation side.

Hence, with the working oil within each retardation angle side oil chamber 16 and 16 sucked via the second hydraulic passage 21, the inner side of each oil chamber 16 and 16 becomes a relatively low pressure state.

On the other hand, the sucked working oil is drained within the first hydraulic passage 20 from the first port due to a pump compression action and is supplied within one advance angle side oil chamber 15 via the other advance angle side oil chamber 15.

Their inner sides provide a high pressure.

Therefore, within the vane 14 revolved in the clockwise direction in FIG. 1A, the camshaft 2 is pivoted in the same direction as the camshaft 2 itself revolves. Then, the pivotal phase S is converted to an advance angle side.

Consequently, the open-and-closure timing of the intake valve is advanced so that the engine output under the high-speed-and-high-load region can be improved.

In a case where the camshaft 2 is pivoted in the maximum advance angle position, the controller 36 commands the driver 38 to stop the normal rotation of the motor 34 so that the operation of the oil pump 22 is stopped. The vane 14 is held at the rotation position.

Furthermore, the hydraulic (oil pressure) selectively supplied to each oil chamber 15 and 15 or 16 and 16 basically in mutually opposite directions. When a leakage occurs from a gap between each teeth 29 and 31 of the oil pump 22 and either the first or second port becomes negative pressure, the intake valve 26 or 27 at the suction side is opened.

An insufficient amount of each oil chamber 15, 15, 16 or 16 is, then, auxiliarily filled via an auxiliary passage 25 or a communication passage 23 from a working oil within the reservoir tank 24 within either a check valve 26 or 27 at the suction side.

In the first embodiment, after the vane 14 is revolved at the advance angle side or at the retardation angle side, the revolution of the motor 34 is stopped and the oil pump 22 is stopped. Furthermore, together with a change in the engine driving condition, the motor 34 is driven in the opposite direction so that the oil pump 22 is rotated in the opposite direction, the working oil is supplied to either one oil chamber 15 or 16. Hence, a reduction of the energy efficiency through the oil pump 22 can be prevented and an energy loss can be suppressed.

Since the high-cost electromagnetic switching valve is not needed, the control apparatus in the first embodiment becomes advantageous in terms of cost.

(Second Embodiment)

Figure 4:
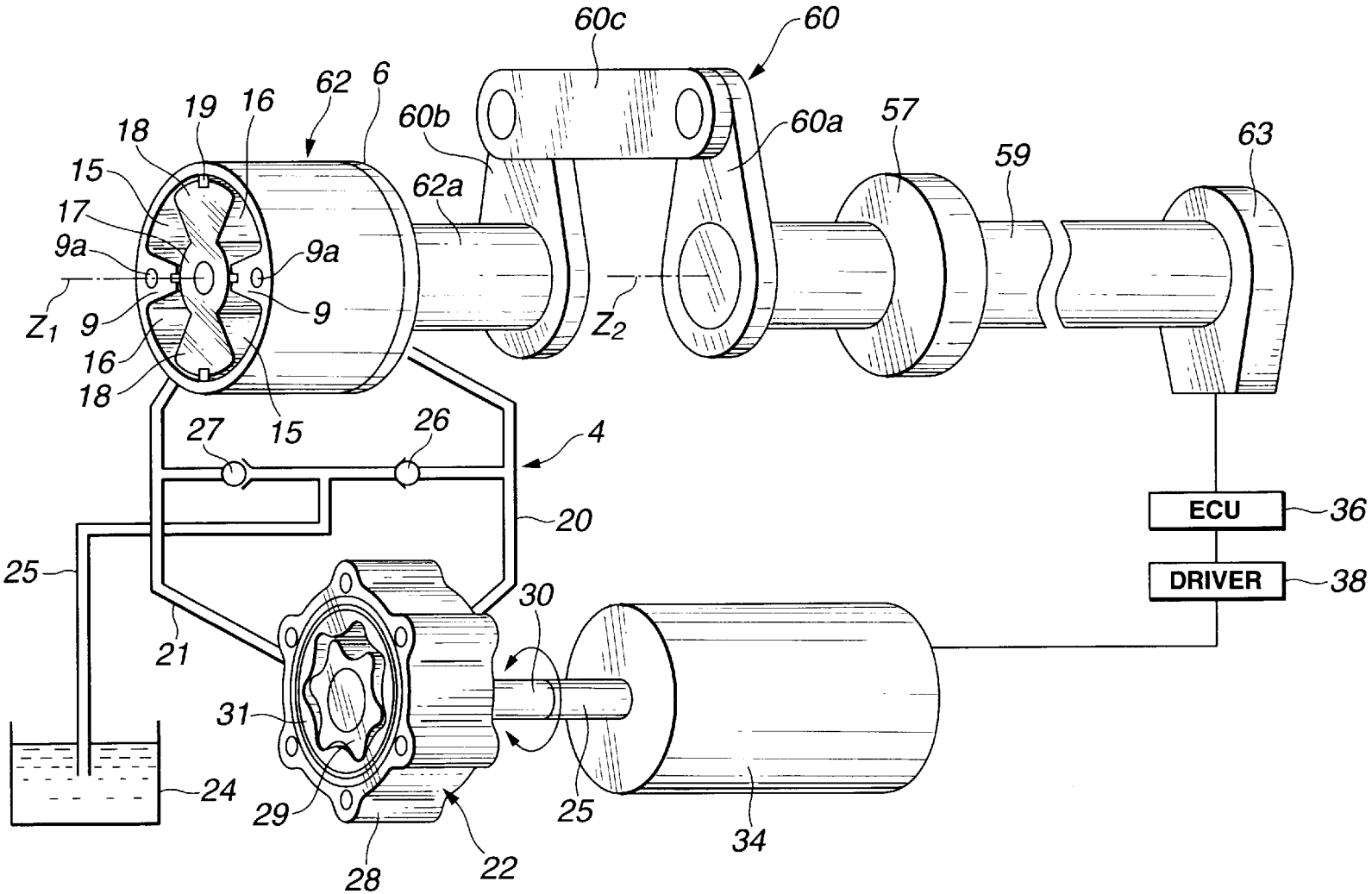
FIG. 4 is a generally perspective view of the control apparatus in a second preferred embodiment according to the present invention.

FIG. 4 shows a second preferred embodiment of the control apparatus for the variably operated engine valve according to the present invention.

In the second embodiment, the phase converter 3 is applicable to the variable open-and-closure timing controlling apparatus disclosed in a Japanese Patent Application First Publication No. Heisei 6-2516 which corresponds to a U.S. Pat. No. 5,557,983 issued on Sep. 24, 1996, the disclosure of which is herein incorporated by reference.

In the second embodiment, the converter of the vane type is utilized as a hydraulic actuator of an operation mechanism to operate the phase converter 3.

Figure 5:
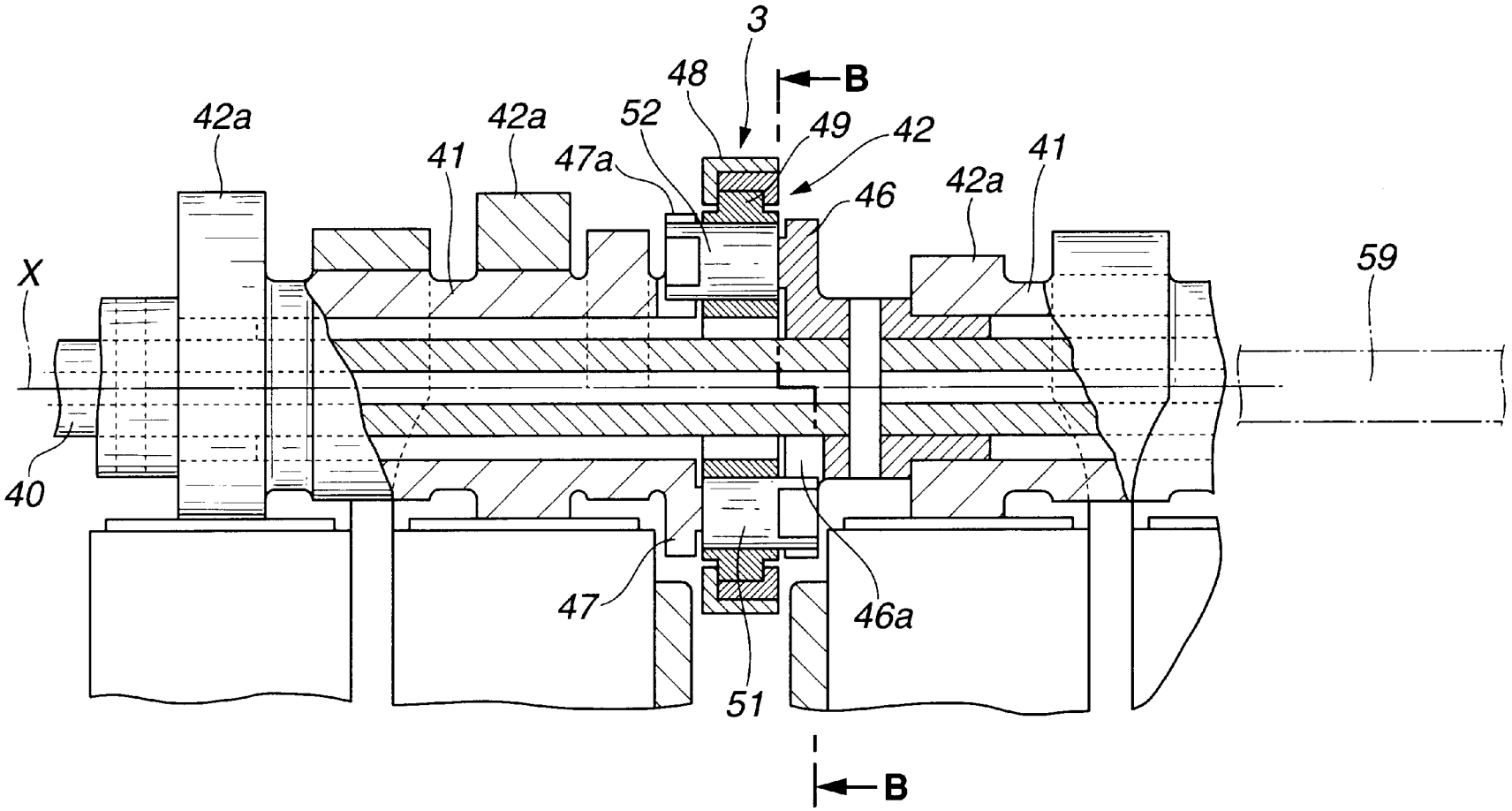
FIG. 5 is a cross sectional view of the phase converter in the case of the second preferred embodiment shown in FIG. 4.
Figure 6:
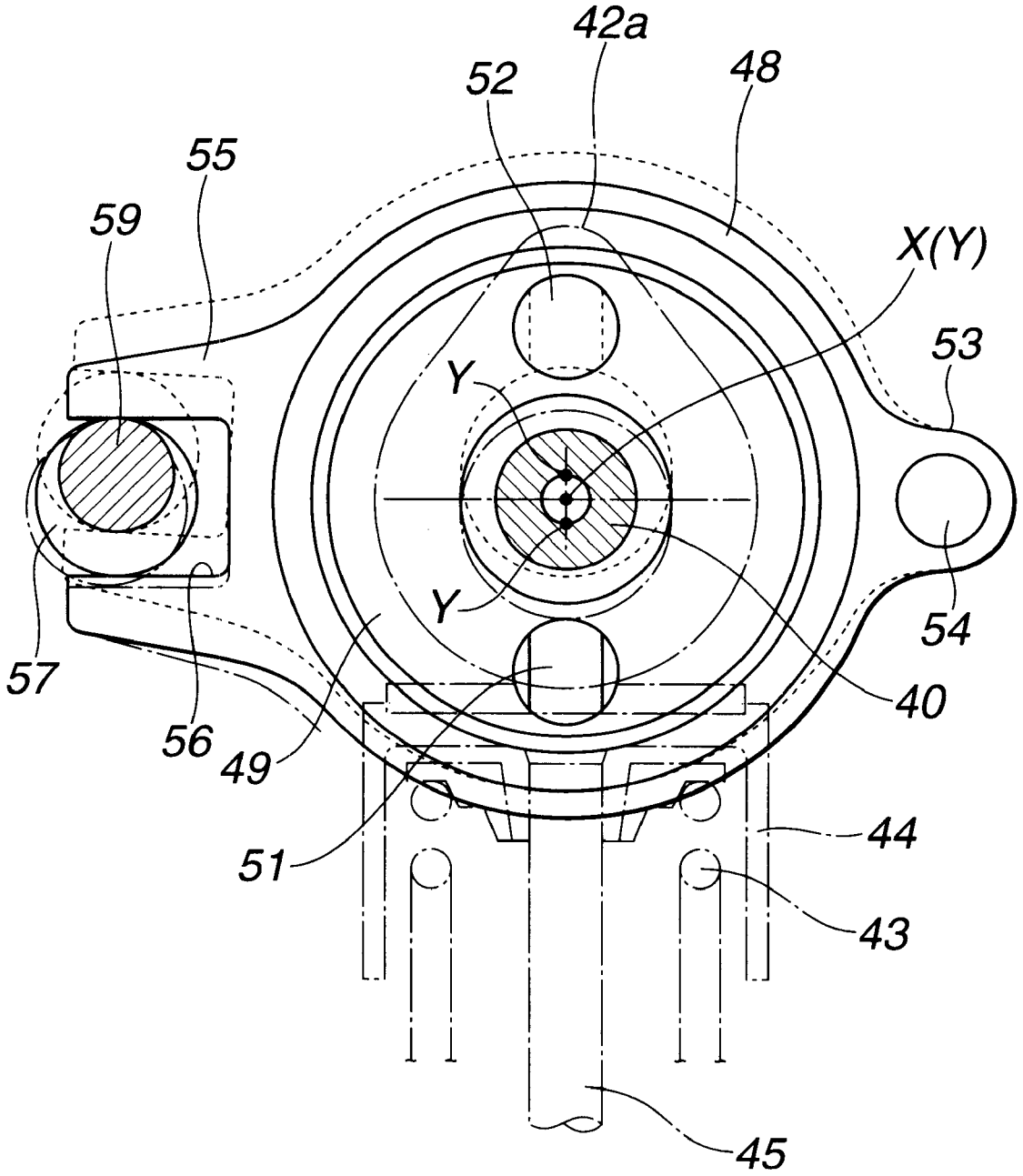
FIG. 6 is a cross sectional view of the phase converter shown in FIG. 5 cut away along a line of B—B in FIG. 5.

The phase converter 3 is constituted as shown in FIGS. 5 and 6.

In FIGS. 5 and 6, reference numeral 40 is a drive axle of an inner side hollow shape, reference numeral 41 is a camshaft disposed on the same axle as an outer periphery of the drive axle 40 for each cylinder, reference numeral 42 denotes a control mechanism for varying the pivotal phase of both drive axles 40 and 41. The camshaft 41 is provided with two cams 42*a* per cylinder to open the intake valve 45 via a valve lifter 44 against a spring force of a valve spring on its outer periphery.

The control mechanism 42 includes: first and second flange portions 46 and 47; an approximately ring-shaped disc housing 48 disposed between both of the first and second flange portions 46 and 47; an annular disc 49 rotatably held within an inner periphery of the disc housing 48; and engagement pins 51 and 52 slidably engaged with letter-U shaped engagement grooves 46*a* and 47*a* of the respective flange portions 46 and 47.

In addition, FIG. 6 shows a structure of the disc housing 48.

As shown in FIG. 6, with a spindle 53 inserted within a supporting hole formed on a boss portion 53 of one end of the disc housing 48 and the other end thereof is swingably supported in upward and downward directions.

The disc housing 48 is swung according to the pivotal movement of an eccentric cam 57 arranged within the cam groove 56 formed on the boss portion 55 at the other end thereof. The eccentric cam 57 is of a ring shape and is fixed on a control shaft 59 of an operation mechanism 58 through a penetration hole formed in an axial direction thereof.

The operation mechanism 58 includes: a control shaft 59 disposed in substantially parallel to the camshaft 41; and a hydraulic actuator 62 associated with a link mechanism 60 on an end of the control shaft 59.

An axial center of the drive rod 62*a* of the hydraulic actuator 62, namely, an axial center Z1 of the rotor portion 17 and an axial center Z2 of the control shaft 59 are eccentrically converged in forward-and-rearward directions as viewed from FIG. 4.

The link mechanism 60 includes: a link arm 60*a* projected radially on an end of the control shaft 59; a link arm 60*b* projected radially on an end of the drive rod 62*a;* and an elongated flat plate-like link member 61*c* each tip end of both link arms 60*a* and 60*b* being rotatably associated. The hydraulic actuator 62 is basically of the same structure as the phase converter except that no gear portion for the sprocket is provided. In addition, the structure of the hydraulic circuit 4 is the same. Hence, a specific explanation will be omitted. It is noted that a rotation portion of the control shaft 59 is detected by a potentiometer 63 and is fedback by the controller 36.

Hence, in the second embodiment, the signal contents from the controller 36 are varied in accordance with a change in the engine driving condition. At the same time, the oil pump 22 is rotated in the normal or reverse direction or steps. Therefore, the lift member 61 is pivoted with the vane 14 so that the control shaft 59 is revolved in the normal or reverse direction. Consequently, the disc housing 48 is caused to swing.

This causes a center Y of a circular disc 49 to become centric or eccentric with respect to an axial center of a drive axle 40 so that a relative angular velocity to each camshaft 41 is varied. This causes a rotational phase difference to be developed. Consequently, the open-and-closure timing of the intake valve 45 can be controlled according to the engine driving condition in the advance angle or retardation angle direction.

Thus, the same action or advantages as the first preferred embodiment can be achieved.

An eccentricity between an axial center Z2 of the control shaft 59 and an axial center Z1 of the rotor 17 of the hydraulic actuator 62 can arbitrarily be set. Hence, a degree of freedom in a layout of the hydraulic actuator 62 can be improved.

(Third Embodiment)

Figure 7:
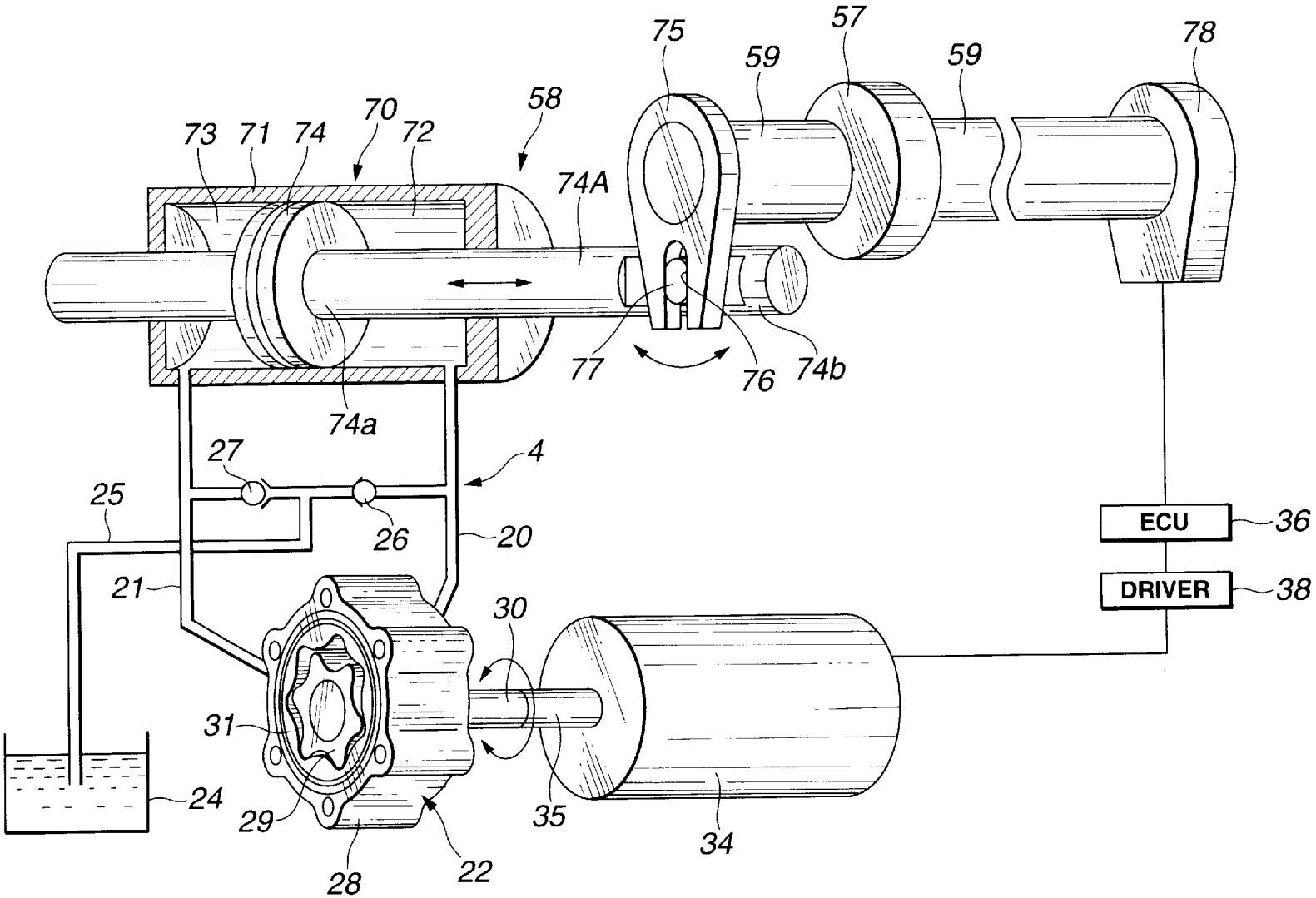
FIG. 7 is a generally perspective view of the control apparatus in a third preferred embodiment according to the present invention.

FIG. 7 shows a third preferred embodiment of the control apparatus for the variably operated engine valve mechanism according to the present invention.

The phase converter 3 and oil pump 22 are the same as those in the second embodiment. In the third embodiment, the hydraulic actuator 70 of the operation mechanism 58 is of a hydraulic cylinder type.

In details, the hydraulic actuator 70 includes: a cylinder housing 71 disposed on the other end of the control shaft 59 and extended along a direction to an axle (viz., piston rod) of a piston 74A, the piston 74 being slidably housed partitioning an inner space of the cylinder 71 into first hydraulic oil chamber 72 and second hydraulic oil chamber 73 and the piston rod 74A having an outer periphery and linked to a center of the piston 74.

The piston rod 74A have one free end 74*b* through which each end of the cylinder housing 71 is penetrated and is linked to a tongue-shaped control plate 75 fixed on a tip of the control shaft 59.

(Fourth Embodiment)

As a fourth embodiment, the present invention is applicable to a lift mechanism type of the variably operated engine valve controlling apparatus disclosed in FIGS. 4, 5, and 6 of a Japanese Patent Application First Publication No. Heisei 11-117719 published on Apr. 27, 1999. The rotation of the vane type used in, for example, the second preferred embodiment.

(Fifth Embodiment)

Figure 8:
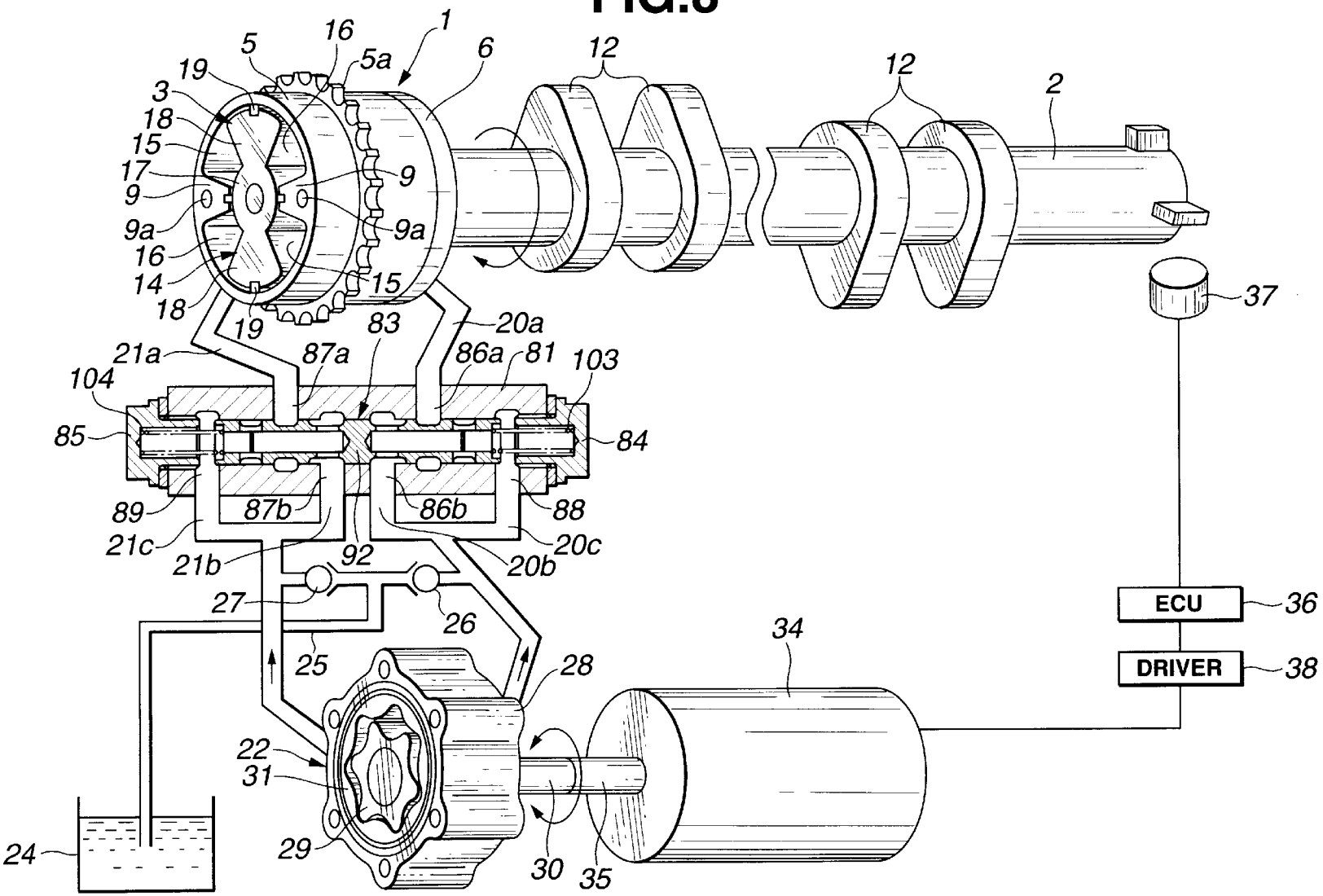
FIG. 8 is a generally perspective and partially cross sectional view of the control apparatus in a fifth preferred embodiment according to the present invention.
Figure 9A:
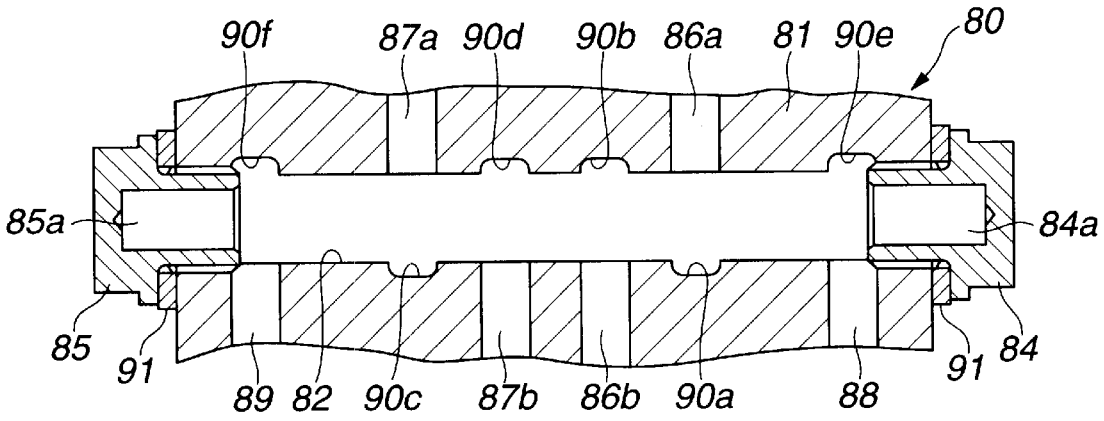
FIG. 9A is a longitudinally cross sectional view of a valve body used in the control apparatus in the fifth preferred embodiment according to the present invention.
Figure 9B:
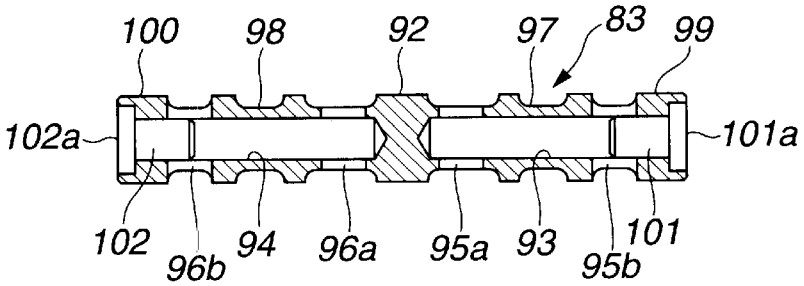
FIG. 9B is a longitudinally cross sectional view of a spool valve used in the control apparatus in the fifth preferred embodiment according to the present invention.

FIGS. 8, 9A, and 9B show a fifth embodiment of the control apparatus.

A single hydraulic check mechanism 80 to check the working oil flow within both hydraulic passages 20 and 21 in accordance with a drain pressure of the oil pump 22 is interposed in a midway through a passage between a first hydraulic passage 20 and a second hydraulic passage 21. The other structure in the fifth embodiment is generally the same as those described in the first embodiment.

The first and second hydraulic passages 20 and 21 are divided by the phase converter 3, each end 20*a* and 21*a* located on the phase converter 3 being formed independently but each end of the passages 20 and 21 located on the oil pump 22 being formed with two branch passages 20*b,* 20*c,* 21*b,* and 21*c.*

The hydraulic check mechanism 80 includes: a cylindrical valve body 81 installed within a retaining hole formed within a main body of the engine; and a spool valve 83 slidably disposed in the axial direction thereof.

The valve body 81 is provided with bolt-type plugs 84 and 85 to close the corresponding end thereof which are screwed axially into open ends of the valve body 81, as shown in FIG. 9A.

Working oil supply and draining holes 86*a* and 87*a* to communicate a valve hole 82 with each end 20*a* and 21*a* at an upper side of a peripheral wall of the valve body 80 as viewed from FIG. 8A are penetrated at a predetermined interval in the axial direction of the valve body 81. On the other hand, working oil supply and draining holes 86*b* and 87*b* to communicate each one branch passage 20*b* and 21*b* with a valve hole 82 are penetrated at an opposing peripheral wall of the valve body 80. Pressure signal holes 88 and 89 are penetrated on both ends of the peripheral wall to communicate the one branch passage 20*b* and 21*b* with the valve hole 82. Pressure signal holes 88 and 89 are penetrated to communicate the other branch passages 20*c* and 21*c* with the valve hole 82 penetrated through both ends of the peripheral wall. Furthermore, grooves 90*a*, 90*b*, 90*c*, and 90*d* are formed on an outer peripheral surface of the valve hole 82 at which respective opening ends of both of working oil supply and draining holes 86*a* and 86*b* and those 87*a* and 87*b* are located. Grooves 90*e* and 90*f* are formed on an inner peripheral surface of the valve hole 82 on which each opening end of pressure signal holes 88 and 89 is positioned.

In addition, each plug 84 and 85 hermetically seals the corresponding valve hole 82 via a corresponding one of seal rings 91 and 91.

Pressure receiving chambers 84*a* and 85*a* are formed in an inside of the valve hole 82.

FIGS. 9B, 10, 11, and 12 show the structure of the spool valve 83.

The spool valve 83 is generally formed of an elongated rod shape. Two passage grooves 93 and 94 are separately formed along an axial direction within an inner space of both sides of a central land portion 92.

A pair of right and left communication holes 96*a* and 96*b* to communicate properly the one working oil supply and draining hole 86*a* with the other working oil supply and draining hole 86*b* at one side of the land portion 92, another pair of right and left communication holes 96*a* and 96*b* to communicate properly the one working oil supply and draining hole 87*a* with the other working oil supply and draining hole 87*b* are penetrated in a radial direction at predetermined intervals, respectively.

In addition, valve bodies 97 and 98 to open and close respective working oil supply and draining holes 86*a* and 87*a* and those 86*b* and 87*b* are installed between the respective communication holes 95*a*, 95*b*, 96*a*, and 96*b*. Valve bodies 99 and 100 are integrally installed to open and close respective pressure signal holes 88 and 89 at both ends of the valve body 80. Blind plugs 101 and 102 are fixed under pressure having pressure receiving surfaces 101*a* and 102*a* receiving signal hydraulic on each outer surface on openings at both ends of the spool valve 83. It is noted that, as typically shown in FIG. 10, a pair of springs 103 and 104 are provided on respective ends having a biasing force to bias the land portion 92, viz., the spool valve 83 at a neutral position.

Figure 10:
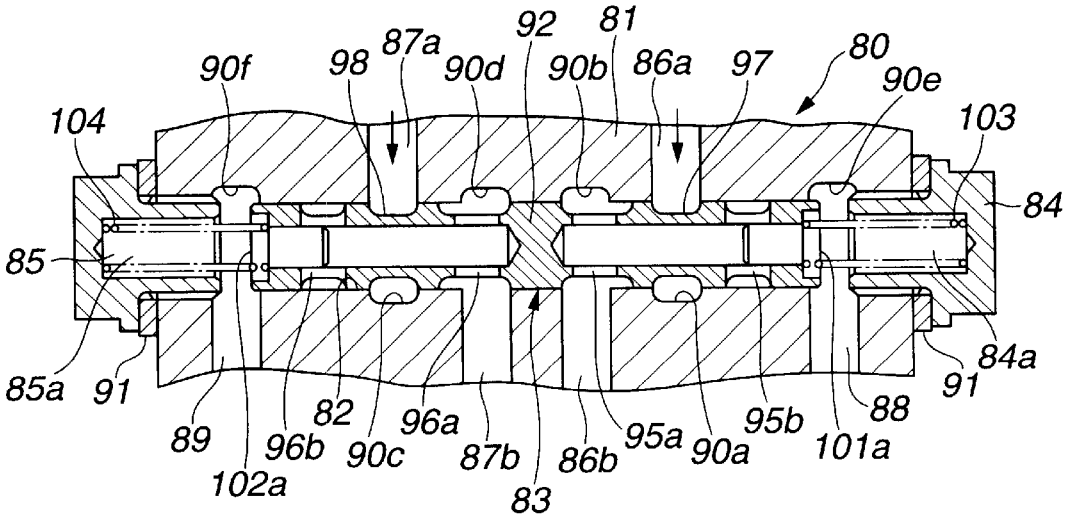
FIGS. 10, 11, and 12 are longitudinally cross sectional views of a hydraulic check mechanism for explaining an operation of the hydraulic check mechanism used in the fifth preferred embodiment shown in FIG. 8.
Figure 11:
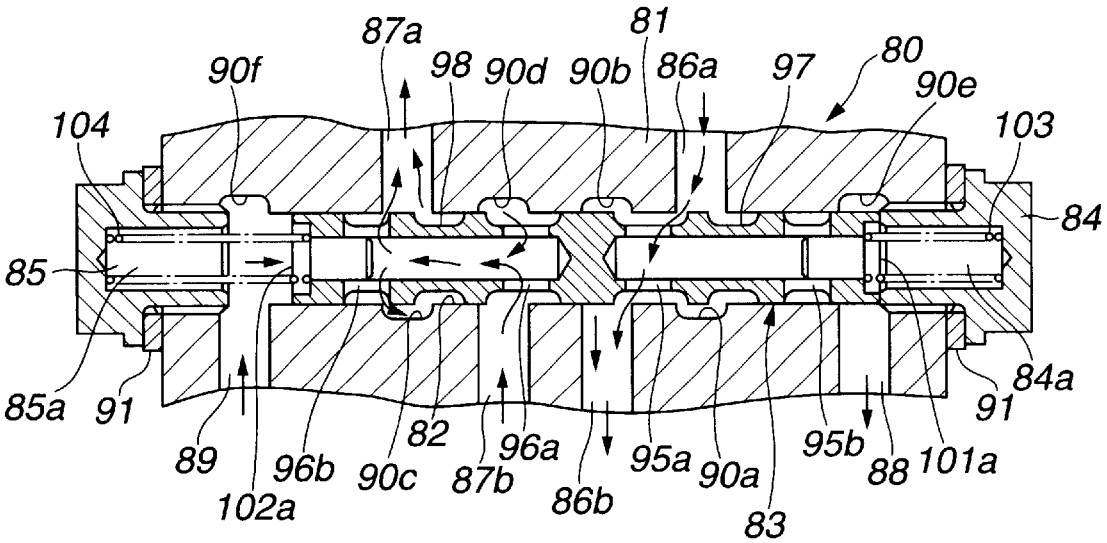

In the fifth embodiment, the oil pump 22 stops during the engine stop and the supply of the working oil to or the drain thereof from each hydraulic passage 20 and 21 is not carried out. At this time, the spool valve 83 is held at a neutral position due to the spring force of both springs 103 and 104 as shown in FIGS. 8 and 10.

Each working oil supply and draining hole 86*a* and 87*a* is closed by both valve bodies 97 and 98 so that a communication of each advance angle side oil chamber 15 and retardation angle side oil chamber 16 with the oil pump 22 is interrupted without failure.

When the engine is started, the spring force exerted by the valve spring of the engine valve causes a torque to be developed on the camshaft 2. This causes the vane 14 to start revolution in either the normal or reverse direction.

However, since each working oil chamber 15 or 16 is still in a tightly closed state, the revolution of the vane 14 in either the normal or reverse direction can be limited in this situation.

Next, when the engine is transferred into the engine low-speed-and-low-load region, the motor 34 performs a pump action with the oil pump 82 reversed. When the hydraulic (working oil) is supplied to the second hydraulic passage 21, part of the working oil is streamed into the pressure receiving chamber 85*a* via the pressure signal hole 89 from the branch passage 21*c* as denoted by arrow mark of FIG. 11 so that the working oil pressure is acted upon pressure receiving surface 102*a*. Hence, the spool valve 83 is slid in the rightward direction against the spring force exerted by the spring 103 as denoted by FIG. 11 so that the valve body 98 is displaced in the rightward direction to open the working oil supply and draining holes 86*a*, 86*b*, 87*a*, and 87*b*. Therefore, the working oil within each advance angle oil chamber 15 is sucked into the oil pump 22 via each working oil supply and draining hole 86*a* and 86*b*, the passage groove 93, and the communication hole 95*a*. At the same time when the inner space of each advance angle side working oil chamber 15 gives the low pressure, the pair of the working oil within the second hydraulic passage 21 is streamed into the end 21*a* (refer to FIG. 8) from the branch passage 21*b* via the working oil supply and draining hole 87*b*, the communication hole 96*a*, the passage groove 94, and the working oil supply and draining hole 87*a* so that each retardation angle side oil chamber 16 provides a high pressure. Consequently, the vane 14 is revolved in the anticlockwise direction so that the pivotal phase S is converted into the retardation angle side.

Figure 12:
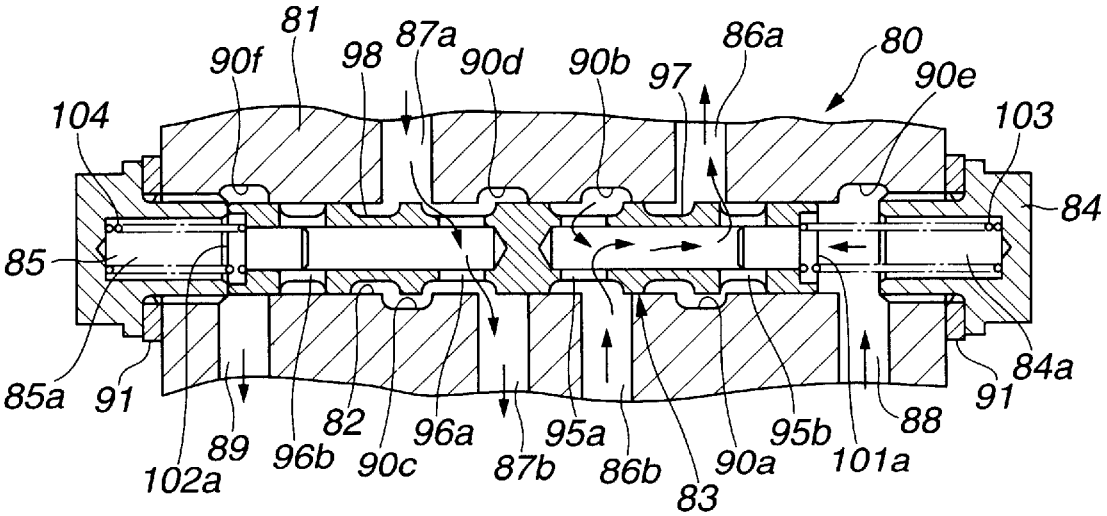

On the other hand, when the engine is transferred into a high-speed-and-high-load region, the oil pump 22 is positively revolved via the motor 34 in the same manner as described in the first embodiment, the working oil sucked into the first hydraulic passage 20 is streamed into the branch passages 20*b* and 20*c* as denoted by the arrow mark in FIG. 12. The working oil within the branch passage 20*c* is streamed into the pressure receiving chamber 84*a* from the pressure signal hole 88 to press the pressure receiving surface 101*a*.

Thus, the spool valve 83 slides in the leftward direction as shown in FIG. 12 against the biasing force of the spring 104 so that the valve body 97 opens the working oil supply and draining holes 86*a*, 86*b*, 87*a*, and 87*b*.

Hence, the working oil within each retardation angle side oil chamber 17 is sucked into the oil pump 22 via each working oil supply and draining hole 87*a*, 87*b*, the passage groove 94, and the communication hole 96*a*. At the same time when the inner space of each retardation angle side oil chamber 16 indicates the low pressure, part of working oil within the first hydraulic passage 21 is streamed into the end 20*a* from the branch passage via the working oil supply and draining hole 86*b*, the communication hole 95*a*, the passage groove 93, and the working oil supply and draining hole 86*a* so that the inner space of each advance angle side oil chamber 15 indicates a high pressure. Hence, the vane 14 is rotated in the clockwise direction and the pivotal phase S is converted into the advance angle side.

Consequently, the control apparatus for the variably operated engine valve mechanism in the fifth embodiment can achieve the same operations and advantages as those described in the fifth embodiment.

Especially, immediately after the engine is started, the spool valve 83 is held at the neutral position and the flow of the working oil with each oil chamber 15 and 16 is blocked. Hence, an unintentional revolution of the oil pump 22 does not occur and a load to be improved in the motor 34 during the engine start can be reduced.

Therefore, it becomes possible to reduce the size and power capacity of the motor 34 sufficiently so that a power consumption and a weight can be reduced.

As described above, since a transmission of an alternating torque from the camshaft 2 can be blocked, an accuracy of control for the reduction of the vane 14 in the normal or reverse direction with the oil pump 22 can be increased and a valve timing control can be stabilized.

In addition, the single spool valve 83 can perform a switching to interrupt the two hydraulic passages 20 and 21. Therefore, a reduction in the number of assembly parts and a small-sizing (minuaturization) of the whole control apparatus can be achieved. In addition, a manufacturing cost can be reduced.

A development in a time lag in the open-and-closure operation in the two hydraulic passages 20 and 21 can be prevented. A highly accurate open-and-closure timing control can, thus, be achieved.

Since the hydraulic check mechanism 80 itself is not electrically controlled but utilizes the presently available hydraulic, an operation response characteristic becomes high and a high rise in the manufacturing cost can be suppressed.

(Sixth Embodiment)

Figure 13:
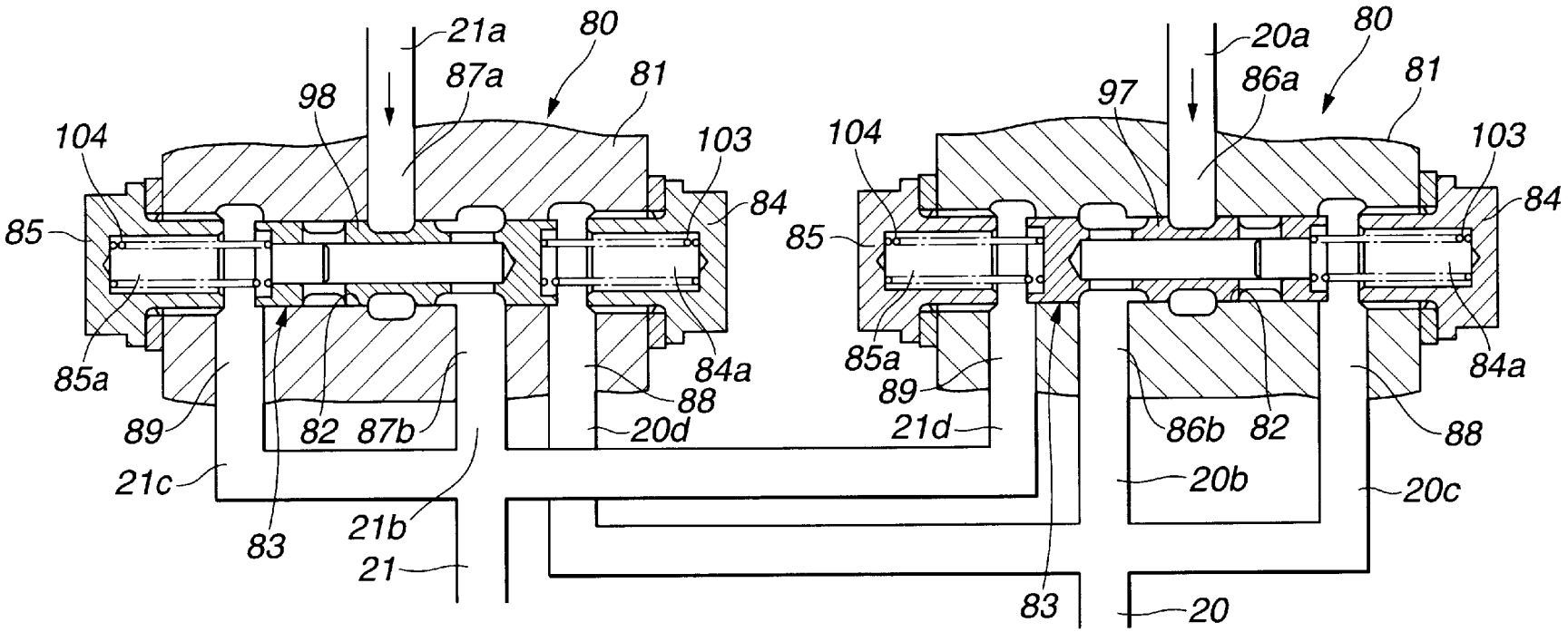
FIG. 13 is a longitudinal cross sectional view of the hydraulic check mechanism used in a sixth preferred embodiment of the control apparatus according to the present invention.

FIG. 13 shows a sixth preferred embodiment of the control apparatus for the variably operated engine valve mechanism according to the present invention.

In FIG. 13, the hydraulic check mechanism 80 is divided into two one for the corresponding one of the first and second hydraulic passages 20 and 21.

The ends of the first and second hydraulic passages 20 and 21 located toward the oil pump 22 are branched into three branch passages 20*b,* 20*c,* 20*d,* 21*b,* 21*c,* and 21*d,* respectively.

Each of the first hydraulic check mechanism 80 and second hydraulic check mechanism 80 includes the valve body 81 and 81 which is short in length and the spool valve 83 and 83 slidably installed spool valve 83 and 83 within the corresponding valve body 81 and 81.

The opening ends of each valve body 81 and 81 are enclosed with plugs 84 and 85. The working oil supply and draining holes 86*a* and 87*a* are formed on upper ends of the respective peripheral walls of the valve bodies 81 and 81 as viewed from FIG. 13.

The opposing working oil supply and draining holes 86*b* and 87*b* formed on lower ends of the respective peripheral walls of the valve bodies 81 and 81 as viewed from FIG. 13 are connected to the branch passages 20*b* and 21*b*. Pressure receiving chambers 84*a* and 85*a* are formed on both ends of each valve hole 82.

The pressure receiving chambers 84*a* and 85*a* are formed with the corresponding branch passages 20*c,* 21*c,* 20*d,* and 21*d* via respectively corresponding pressure signal holes 88 and 89.

Each spool valve 83 and 83 is formed with the corresponding valve body 97 and 98 located at the center position of the corresponding spool valve 83 to relatively communicate or interrupt the working oil supply and draining holes 86*a,* 86*b,* 87*a,* and 87*b*. The communication holes 95*a* and 96*a* are formed respectively on both sides of the respective valve bodies 97 and 98. In addition, each of the spool valves 83 and 83 is held at the neutral position with each pair of springs 103 and 104 and 103 and 104 disposed on both ends of the corresponding spool valve 83.

In the sixth embodiment, when the engine driving state is at a time immediately after the engine start from a time at which the engine stops and at which the hydraulic (working oil) is not supplied, the spring force of each spring 103 and 104 and 103 and 104 causes the corresponding spool valve 83 and 83 to be held at the neutral position, as shown in FIG. 13.

Since each valve body 97 and 98 closes both working oil supply and draining holes 86*a* and 87*a,* the flow of the working oil from each oil chamber 15 and 16 into the oil pump 22 caused by the alternating torque to the camshaft 2 is blocked. Hence, the development of the load applied to the motor 34, at this time, is prevented from occurring.

Figure 14:
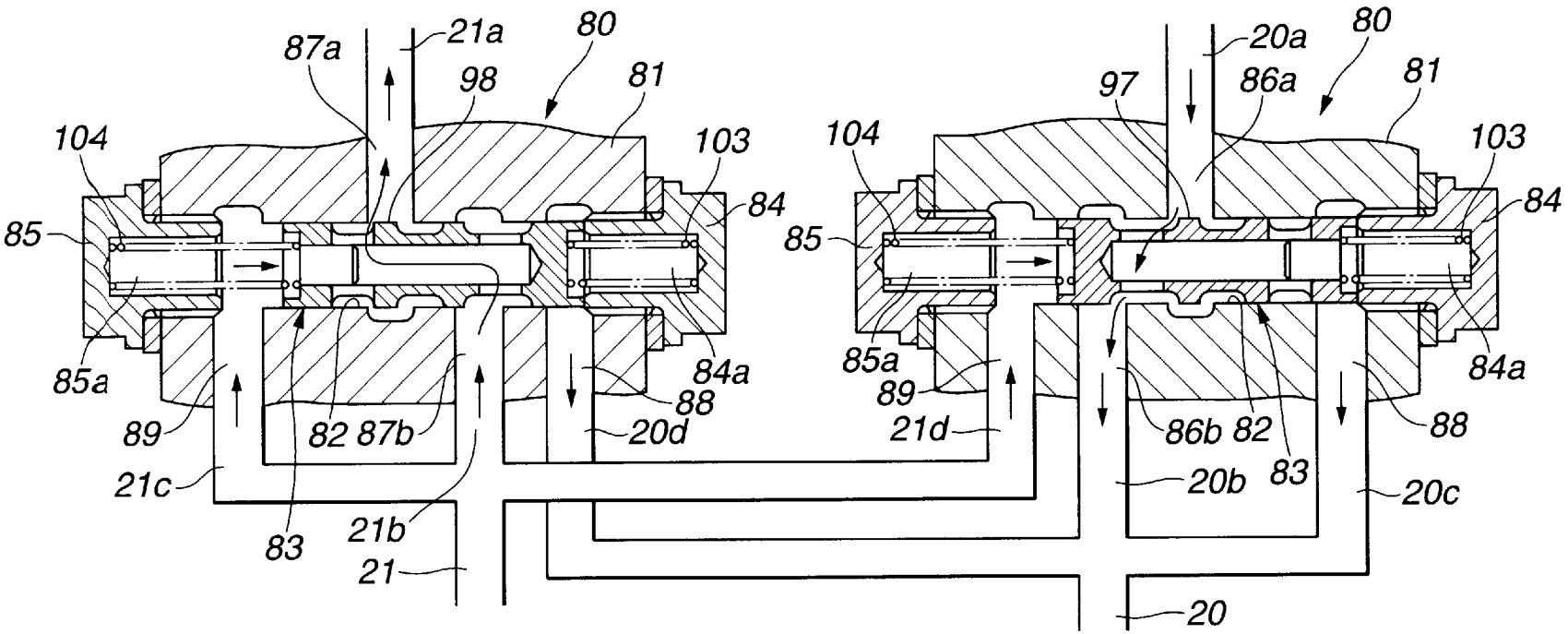
FIGS. 14 and 15 are longitudinal cross sectional views of the hydraulic check mechanism for explaining an operation of the hydraulic check mechanism used in the sixth preferred embodiment shown in FIG. 13.

When the engine driving condition falls in the low-speed-and-low-load region, the oil pump 22 is operated along with the reverse rotation of the motor 34. As denoted by the arrow marks in FIG. 14, the working oil is streamed into both pressure receiving chambers 85*a* and 85*a* located at left sides of the spool valves 83 and 83 in the rightward direction against the biasing forces of the opposing springs 103 and 103. This causes each valve body 97 and 98 to communicate each working oil supply and draining hole 86*a* and 86*b* and 87*b* and 87*b* simultaneously with one another so that while the working oil within each advance angle side oil chamber 15 is sucked into the oil pump 22, the working oil drained from the oil pump 22 is supplied to each retardation angle side oil chamber 16. Thus, the vane 14 is rotated in the single direction and the pivotal phase S of the camshaft 2 is converted toward the retardation angle side.

In addition, when the engine is transferred into the high-speed-and-low-load region, the rotation of the motor 34 is switched in the normal direction and the oil pump 22 is pivoted in the positive direction.

Figure 15:
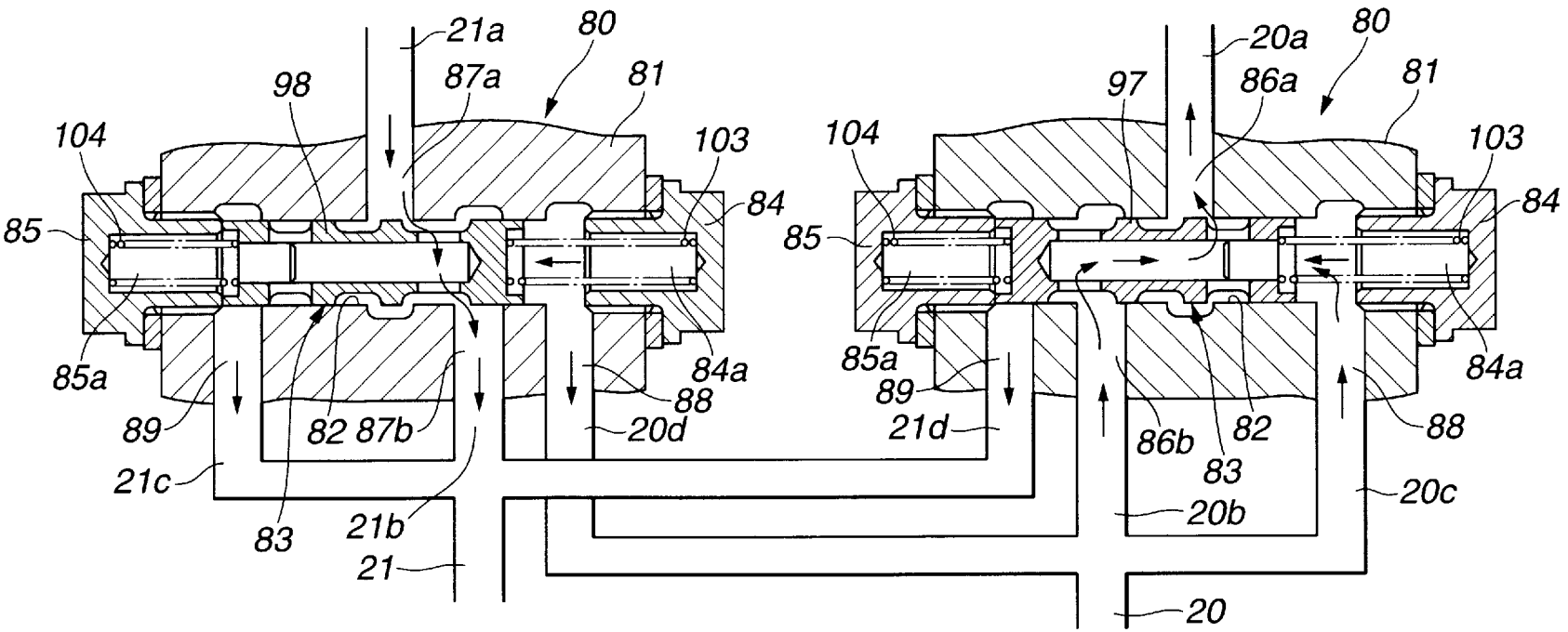

As appreciated from FIG. 15, each spool valve 83 and 83 is slid in the leftward direction as viewed from FIG. 15 according to a high hydraulic within each pressure receiving surface 84*a* and 84*a* so that each working oil supply and draining hole 86*a* and 86*b* and 87*b,* and 87*b* per se is simultaneously communicated. Therefore, the working oil within each retardation angle side oil chamber 16 is sucked into the oil pump 22 as denoted by the arrow marks shown in FIG. 15. On the other hand, the working oil discharged from the oil pump 22 is supplied within each advance angle side oil chamber 15 via the first hydraulic passage 20. Therefore, the vane 14 is rotated in the reverse direction so that the pivotal phase of the camshaft 2 is converted toward the advance angle side.

In the sixth embodiment, in the same way as the fifth embodiment, each hydraulic check mechanism 80 and 80 can reduce the load imposed on the motor 34 during the engine start. Hence, the motor 34 can be small sized. Since the hydraulic check mechanism is divided into the first and second hydraulic check mechanisms 80 and 80, the degree of freedom in the layout of the engine can be improved. In addition, the length of the valve body 81 and 81 can be shortened and a working accuracy can become high.

The entire contents of Japanese Patent Applications No. 2000-8530 (filed in Japan on Jan. 18, 2000) No. 2000-284507 (filed in Japan on Sep. 20, 2000) are herein incorporated by reference. Although the invention has been described above by reference to certain embodiment of the invention, the invention is not limited to the embodiments described above. Modifications and variations of the embodiments described above will occur to those skilled in the art in the light of the above teachings.

For example, it is possible to modify the control apparatus for the variably operated engine valve mechanism, viz., the phase converter and the actuator to operate the phase converter in accordance with a specification of the engine.

The scope of the invention is defined with reference to the following claims.

What is claimed is:

1. A control apparatus for a variably operated engine valve mechanism for an internal combustion engine, comprising:

a phase converter to variably control at least one of a displacement and an open-and-closure timing of an engine valve;

an oil pump to supply a hydraulic to operate the phase converter;

a reversible motor to drivingly revolve the oil pump; and a controller to output a drive current to the reversible motor according to an engine driving condition, the controller controlling a revolution direction of the oil pump via the reversible motor at least when an operation of the phase converter is switched.

2. A control apparatus for a variably operated engine valve mechanism of an internal combustion engine as claimed in claim 1, wherein the reversible motor is a DC motor.

3. A control apparatus for a variably operated engine valve mechanism of an internal combustion engine as claimed in claim 1, wherein the phase converter comprises: a hollow sprocket to be synchronized with a revolution of an engine crankshaft; a vane fixed onto a free end of a camshaft and housed rotatably into a housing of the sprocket; a pair of advance angle side and retardation angle side oil chambers, each pair thereof being formed within the housing of the sprocket and positioned with the vane and a pair of mutually opposing partitioning walls formed within the housing of the sprocket; and a hydraulic circuit to supply selectively the hydraulic from the oil pump into each pair of the advance angle side and retardation angle side chambers to control a revolution portion of the vane.

4. A control apparatus for a variably operated engine valve mechanism of an internal combustion engine as claimed in claim 3, wherein the vane comprises a cylindrical rotor located at a center of the housing of the sprocket and fixed onto the free end of the camshaft and a pair of blades extended from the cylindrical rotor toward an inner peripheral wall of the housing of the sprocket to partition each pair of the oil chambers with the partitioning walls.

5. A control apparatus for a variably operated engine valve mechanism of an internal combustion engine as claimed in claim 4, wherein the hydraulic circuit comprises: a first hydraulic passage to supply or drain the hydraulic to the pair of advance angle side oil chambers; the oil pump to selectively supply the hydraulic to each of the pair of the first and second hydraulic passages; a communication passage to communicate with each of the first and second hydraulic passages; an auxiliary hydraulic supply passage comprising a downstream end connected to the communication passage and an upstream end connected to a reservoir tank and a pair of check valves installed within parts of the communication passage with the downstream end of the auxiliary hydraulic passage sandwiched in the auxiliary hydraulic supply passage to allow the hydraulic to be entered only in a direction to each of the first and second hydraulic passages.

6. A control apparatus for a variably operated engine valve mechanism of an internal combustion engine as claimed in claim 5, wherein the oil pump comprises a pump axle connected to an output axle of the reversible motor.

7. A control apparatus for a variably operated engine valve mechanism of an internal combustion engine as claimed in claim 6, further comprising a timing sensor to detect a pivotal phase of the camshaft and the controller outputs a control phase signal to a driver to rotate the motor on the basis of the pivotal phase signal from the timing sensor and an engine driving condition.

8. A control apparatus for a variably operated engine valve mechanism of an internal combustion engine as claimed in claim 1, wherein the phase converter comprises a hollow drive axle; a camshaft co-axially arranged on an outer periphery of the drive axle; and a control mechanism to enable a variation in a pivotal phase between the drive axle and the camshaft, on an outer periphery of the camshaft a cam is provided per a cylinder.

9. A control apparatus for a variably operated engine valve mechanism of an internal combustion engine as claimed in claim 8, wherein the control mechanism comprises: first and second flange portions; a substantially ring shaped disc housing assembly interposed between both of the first and second flange portions; a ring-shaped disc rotatably housed within an inner periphery of the disc housing; and engagement pins comprising one ends rotatably fixed onto a radial position of the ring-shaped disc along an axial direction of the camshaft and tips thereof slidably engaged with letter-U shaped engagement grooves of the respective flange portions.

10. A control apparatus for a variably operated engine valve mechanism of an internal combustion engine as claimed in claim 9, wherein the disc housing assembly comprises a first boss portion formed on one end thereof; a spindle inserted within a supporting hole formed on the boss portion to enable a swing of the other end thereof with the spindle as a fulcrum; and an eccentric cam on a second boss portion of the disc housing assembly to enable the swing of the other end thereof along with a pivotal movement of the eccentric cam, the eccentric cam being fixed on a control shaft of an operation mechanism.

11. A control apparatus for a variably operated engine valve mechanism of an internal combustion engine as claimed in claim 10, wherein the operation mechanism comprises: the control shaft disposed in parallel to the camshaft; and a hydraulic actuator connected to one end of the control shaft via a link mechanism.

12. A control apparatus for a variably operated engine valve mechanism of an internal combustion engine as claimed in claim 11, wherein the link mechanism comprises: a first link arm projected radially from the one end of the control shaft; a second link arm projected radially from an end of a drive axle of the hydraulic actuator; and a third link arm to link each tip of the first and second link arms so that an axial center of the hydraulic actuator is eccentric to the axial center of the control shaft.

13. A control apparatus for a variably operated engine valve mechanism of an internal combustion engine as claimed in claim 12, wherein the hydraulic actuator comprises: a cylinder disposed along a vertical direction to the axle of the control shaft; a piston slidably housed within the cylinder and comprising a piston rod to partition an inner space of the housing into first and second oil chambers, wherein the vane comprises a cylindrical rotor located at a center of the housing of the sprocket and fixed onto the free end of the camshaft and a pair of blades extended from the cylindrical rotor toward an inner peripheral wall of the housing of the sprocket to partition each pair of the oil chambers with the partitioning walls, and wherein the hydraulic circuit comprises: a first hydraulic passage to supply or drain the hydraulic to the pair of advance angle side oil chambers; the oil pump to selectively supply the hydraulic to each of the pair of the first and second hydraulic passages; a communication passage to communicate with each of the first and second hydraulic passages; an auxiliary hydraulic supply passage having a downstream end connected to the communication passage and an upstream end connected to a reservoir tank; and a pair of check valves installed within parts of the communication passage with the downstream end of the auxiliary hydraulic passage sandwiched if the auxiliary hydraulic supply passage to allow the hydraulic to be entered only in a direction to each of the first and second hydraulic passages.

14. A control apparatus for a variably operated engine valve mechanism of an internal combustion engine as claimed in claim 12, wherein the hydraulic actuator comprises: a vane fixed onto a free end of a camshaft and housed rotatably into a housing thereof; a pair of advance angle side and retardation angle side oil chambers, each pair thereof being formed within the housing of the vane and positioned with the vane and a pair of mutually opposing partitioning walls formed within the housing; and a hydraulic circuit to supply selectively the hydraulic from the oil pump into each pair of the advance angle side and retardation angle side chambers to control a revolution portion of the vane.

15. A control apparatus for a variably operated engine valve mechanism of an internal combustion engine as claimed in claim 5, further comprising a hydraulic check mechanism interposed between both of the first and second hydraulic passages to check a working oil flow through each of the first and second hydraulic passages in accordance with a discharge pressure of the working oil by the oil pump.

16. A control apparatus for a variably operated engine valve mechanism of an internal combustion engine as claimed in claim 15, wherein the hydraulic check mechanism comprises a cylindrical valve body and a spool valve slidably installed within a cylindrical valve hole of the valve body, the valve body comprising a plurality of hydraulic supply and draining holes to communicate the oil pump with the respective advance and retardation angle side oil chambers and the spool valve being slid to open and close the respective hydraulic supply and draining holes in accordance with the hydraulic supplied from either the first or second hydraulic passage to and from both pairs of the advance and retardation angle side oil chambers.

17. A control apparatus for a variably operated engine valve mechanism of an internal combustion engine as claimed in claim 16, wherein the valve body comprises: plugs to enclose each axial end of the valve hole; a pair of first hydraulic supply and draining holes penetrated through a first outer periphery of the valve body at a predetermined interval of distance in the axial direction of the valve hole to communicate the valve hole with a corresponding end of each of the first and second hydraulic passages located toward the phase converter; a pair of second hydraulic supply and draining holes penetrated through a second outer periphery of the valve body at another predetermined interval of distance to communicate the valve hole with a corresponding branch passage of each of the first and second hydraulic passages located toward the oil pump; a pressure signaling hole penetrated through a corresponding one end of the valve body to communicate the valve hole with another corresponding branch passage of each of the first and second hydraulic passages; a plurality of grooves formed on each part of the peripheral surfaces of the valve body faced against the first and second hydraulic supply and draining holes and pressure signaling holes and the spool valve comprises: a center land portion; a pair of passage grooves separately formed along an axial direction of the spool valve with the land portion sandwiched; a pair of first communication holes penetrated radially through one side of the land portion to communicate one of the first hydraulic supply and draining holes with one of the second hydraulic supply and draining holes; a pair of second communication holes penetrated radially through the other side of the land portion to communicate the other of the first hydraulic supply and draining holes with the other of the second hydraulic supply and draining holes; a pair of spool valve bodies interposed between the pair of communication holes to open and close each of the pairs of the first and second hydraulic supply and draining holes, respectively; a pair of other spool valve bodies integrally installed on each end of the spool valves to open or close pressure signaling hole; and a pair of blind plugs comprising pressure receiving surfaces installed on the respective openings of the spool valve to receive a signal of the working oil in the corresponding one of the first and second hydraulic passages; and a pair of springs installed on the respective ends of the spool valve and the plugs whose spring forces cause the spool valve to be held at a neutral position.

18. A control apparatus for a variably operated engine valve mechanism of an internal combustion engine as claimed in claim 16, wherein the hydraulic check mechanism comprises a first hydraulic check mechanism for the first hydraulic supply and draining passage and a second hydraulic check mechanism of the same structure as the first hydraulic check mechanism for the second hydraulic passage.

* * * * *